US005337432A

United States Patent [19]

Pirhonen

[11] Patent Number: 5,337,432

[45] Date of Patent: Aug. 16, 1994

[54] METHOD OF SHAPING AND A SERIES OF SHAPING IMPLEMENTS FOR SLALOM BOOTS

[76] Inventor: Markku Pirhonen, Mäntykatu 12, SF-40630 Jyväskylä , Finland

[21] Appl. No.: 854,997

[22] PCT Filed: Oct. 30, 1990

[86] PCT No.: PCT/FI90/00259

§ 371 Date: Jun. 5, 1992

§ 102(e) Date: Jun. 5, 1992

[87] PCT Pub. No.: WO91/06230

PCT Pub. Date: May 16, 1991

[30] Foreign Application Priority Data

Oct. 31, 1989 [FI] Finland ..... 895154

[51] Int. Cl.[5] ..... A43D 5/00

[52] U.S. Cl. ..... 12/115.2; 12/114.4

[58] Field of Search ..... 12/115.2, 114.2, 114.4, 12/115.4, 116.8, 119.5, 142 N, 146 M; 36/93, 94, 95, 88, 119

[56] References Cited

U.S. PATENT DOCUMENTS

| | | | |
|---|---|---|---|
| 635,033 | 10/1899 | Bemis | 12/114.4 |
| 934,556 | 9/1909 | Malmberg | 12/115.2 |
| 1,024,869 | 4/1912 | Smith | 12/115.2 |
| 1,453,608 | 5/1923 | Sprague | 12/115.2 |
| 1,792,192 | 2/1931 | Sordelett | 12/114.4 |
| 2,500,917 | 3/1950 | Nathan | 12/115.2 |
| 3,419,974 | 1/1969 | Lange | 36/120 |
| 3,895,405 | 7/1975 | Edwards | 36/93 |
| 3,952,357 | 4/1976 | O'Sullivan | 12/115.2 |
| 4,060,869 | 12/1977 | Brown | 12/115.2 |
| 4,463,761 | 8/1984 | Pols et al. | 36/88 |

FOREIGN PATENT DOCUMENTS

| | | | |
|---|---|---|---|
| 275440 | 5/1979 | Fed. Rep. of Germany | 12/115.2 |
| 20800 | of 1896 | United Kingdom | 12/115.2 |

*Primary Examiner*—Steven N. Meyers
*Attorney, Agent, or Firm*—C. J. Fildes & Co.

[57] ABSTRACT

A method is disclosed of shaping and a series of shaping implements for slalom boots, in which the slalom boot consists of a hard plastic outer shell and an inner boot manufactured from a flexible material. In accordance with the invention the boot is shaped to a perfect fit for the user as follows: a boot of the correct length is selected in accordance with the user's foot; the individual forms of the foot protruding from the boot are recorded; a point in the outer shell corresponding to each protrusion is shaped as follows: the point to be shaped is heated locally from the outside by hot-air blowing; the heated point is pressed from inside by means of a wooden piece, when the plastic material stretches and a protrusion arises.

6 Claims, 5 Drawing Sheets

METHOD OF SHAPING AND A SERIES OF SHAPING IMPLEMENTS FOR SLALOM BOOTS

TECHNICAL FIELD

This invention relates to slalom boots and more particularly to a method of shaping and a series of shaping implements of slalom boots, in which the slalom boot consists of an outer shell made from hard plastic and an inner boot made from flexible material.

BACKGROUND ART

A slalom boot should transfer the movements of the foot precisely as a force directed at the ski. On the other hand, a slalom boot should fit the individual foot of the user without any feeling of cramping. In accordance with the known technique it is as such possible to shape a boot entirely in accordance with the user's foot by first choosing a large outer shell and by fitting the inner boot to the shape of the user's foot with the aid of urethane foam. Operationally a boot of this kind is not, however, optimal, because the excessive flexibility of the inner boot reduces the technical operation of the boot.

In certain slalom boot models there are adjustments to alter the height of the arch of the foot and to tilt the ankle to a limited amount to a desired angle. In any event the boot is not a perfect fit for most users and it is generally believed that a slight cramping by the boot is normal.

Because the costs of the forms used in the manufacture of the outer shell are high, it is not possible to manufacture even different shapes in the same model and size. On the other hand even this would not be sufficient, because there is such an immense number of combinations of different anatomical properties that a solution of this kind is not possible.

A slalom boots and implements to shape it locally in accordance with the user's foot are shown in patent publication U.S. Pat. No. 3,419,974. According to this a piece to be heated is pressed outwards from inside the shell of the boot. In practice shaping of a boot with an implement of this kind is rather limited unless high temperatures are used in heating it, which may then damage the plastic material of the boot. The grades of plastic used at present in boots stick easily to a heating head. On the other hand the publication gives no hint as to how the anatomical form of the foot is transferred to the inside of the boot in the form of directions for shaping.

DISCLOSURE OF INVENTION

An object of this invention is to create a method of shaping and a series of shaping implements for slalom boots, by means of which a foot with nearly arbitrary properties can be fitted to existing slalom boots.

In carrying out the above object, the characteristic features of the shaping method in accordance with the invention are preformed on a slalom boot consisting of a hard plastic outer shell and an inner boot made of flexible material. A boot of the correct length is selected in accordance with the user's foot and the individual forms of the foot protruding from the boot are recorded. A point in the outer shell corresponding to each protrusion is shaped by locally heating the point to be shaped and pressing from inside the heated point, when the plastic material stretches and a protrusion arises. The heating is carried out by hot-air blowing from outside and the internal pressing by means of a wooden shaping head. The characteristics of a series of implements developed for the shaping of the outer shell of the boot consist of a hot-air blower, at least one pressing device and one or more wooden shaping heads to be attached to the pressing device. From the point of view of the invention it is essential that it makes it possible to select a boot of the correct length, after which the outer shell of the boot is given a shape fitting the foot. The shaping is most advantageously carried out with the aid of hydraulic pressing devices, in which wooden pressing heads are used. A wooden pressing head does not adhere to the plastic material, which would hinder the shaping. Other advantages and forms of application of the invention appear later.

In what follows the invention is illustrated with the aid of the accompanying figures, which show one form of application of the invention and advantageous series of implements.

BEST MODE FOR CARRYING OUT THE INVENTION

Figure 1A:
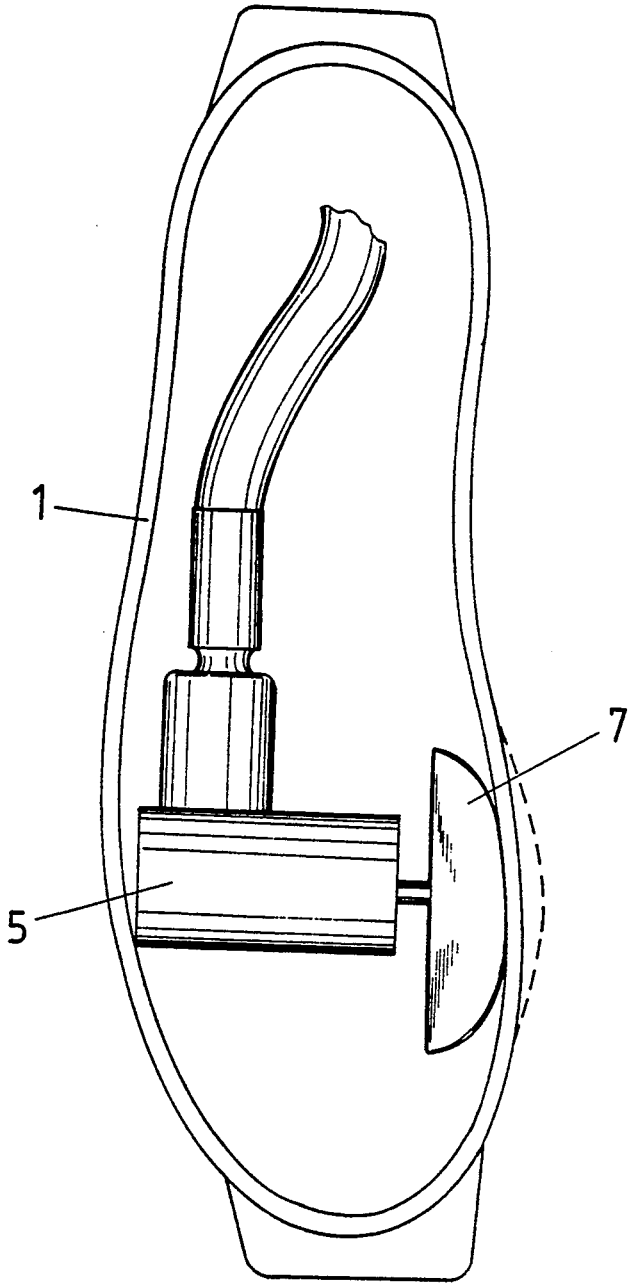
FIG. 1A shows the correction of a boot being carried out in accordance with the present invention.
Figure 1B:
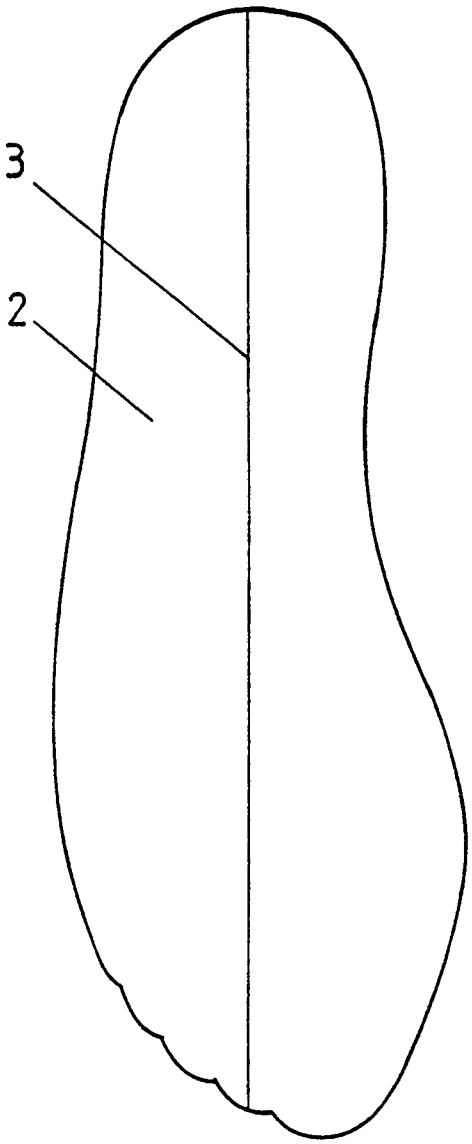
FIG. 1B shows a pattern made in accordance with a foot.

Referring to the drawing figures, a slalom boot consists of a hard plastic outer shell 1 and inner boot made of flexible material. In FIGS. 1A and 1B the outer boot is cut above the sole and the hydraulic pressing device 5 is placed inside the boot. The hydraulic pressing device 5 includes a pressing head 9 made from birch wood, which forms the desired protrusion.

The shaping of the boot begins, however, with the measuring of the foot. The length of the foot principally determines the initial blank to be selected, which consists of an industrially manufactured slalom boot. In addition to the length of the foot its shape is also recorded by the pattern 2, which generally will not fit into a boot of the correct length. A cut 3 is made in the cardboard pattern 2, by means of which it can easily be bent to such an angle that it fits inside the outer shell 1 of the boot to be shaped. The places to be shaped can then be easily located.

The place to be shaped is heated with a hot-air blower from both inside and out, when the plastic material softens, which makes it possible to shape it. With the aid of the hydraulic pressing device 5 the heated place is pressed by means of the wooden pressing head 9, when a protrusion is created. After this the pattern 2 is once again compared with the shaped outer shell. It may require several shapings before the pattern fits the selected boot.

In addition to the individual sole profile there may be higher individual features in the foot. Among other things the ankle bones require their own corresponding protrusion in the outer shell.

Figure 2A:
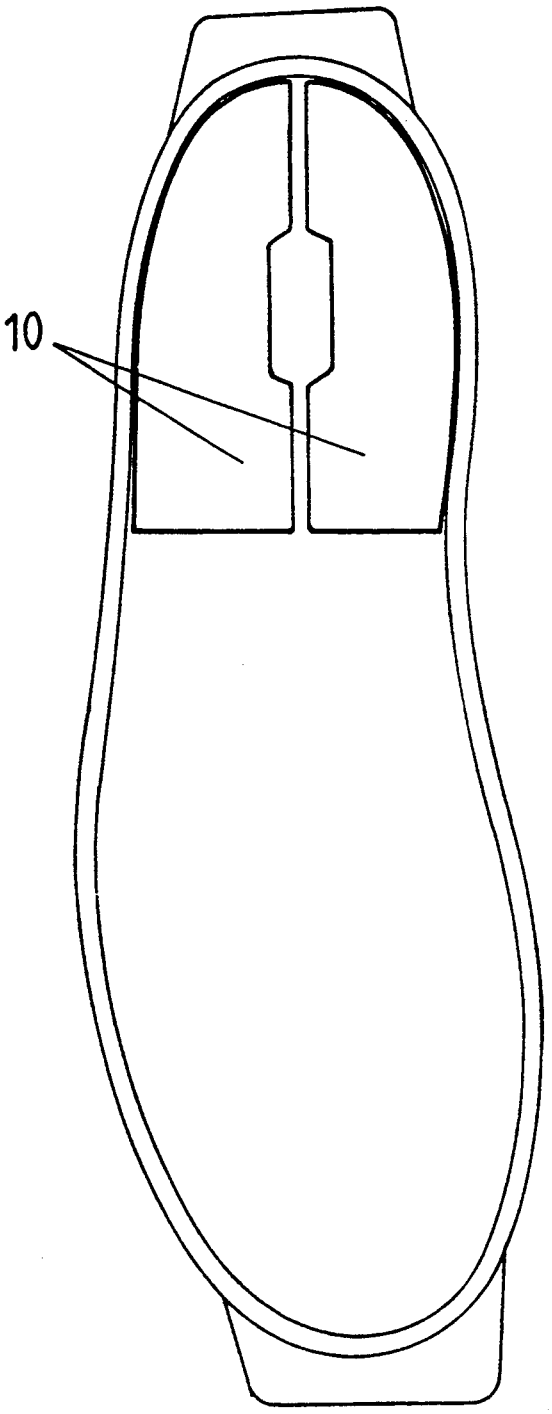
FIG. 2A shows a pressing device intended to shape the heel.
Figure 2B:
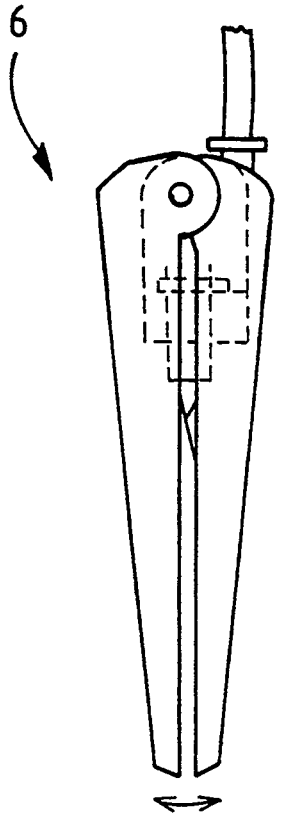
FIG. 2B shows a pressing head.

A special device, shown in FIGS. 2A and 2B, has been developed for broadening the heel. A pressing pair 10, which is spread with the aid of hydraulic pressing device 6, is made from birch wood. Otherwise the shaping takes place as above.

Figure 3:
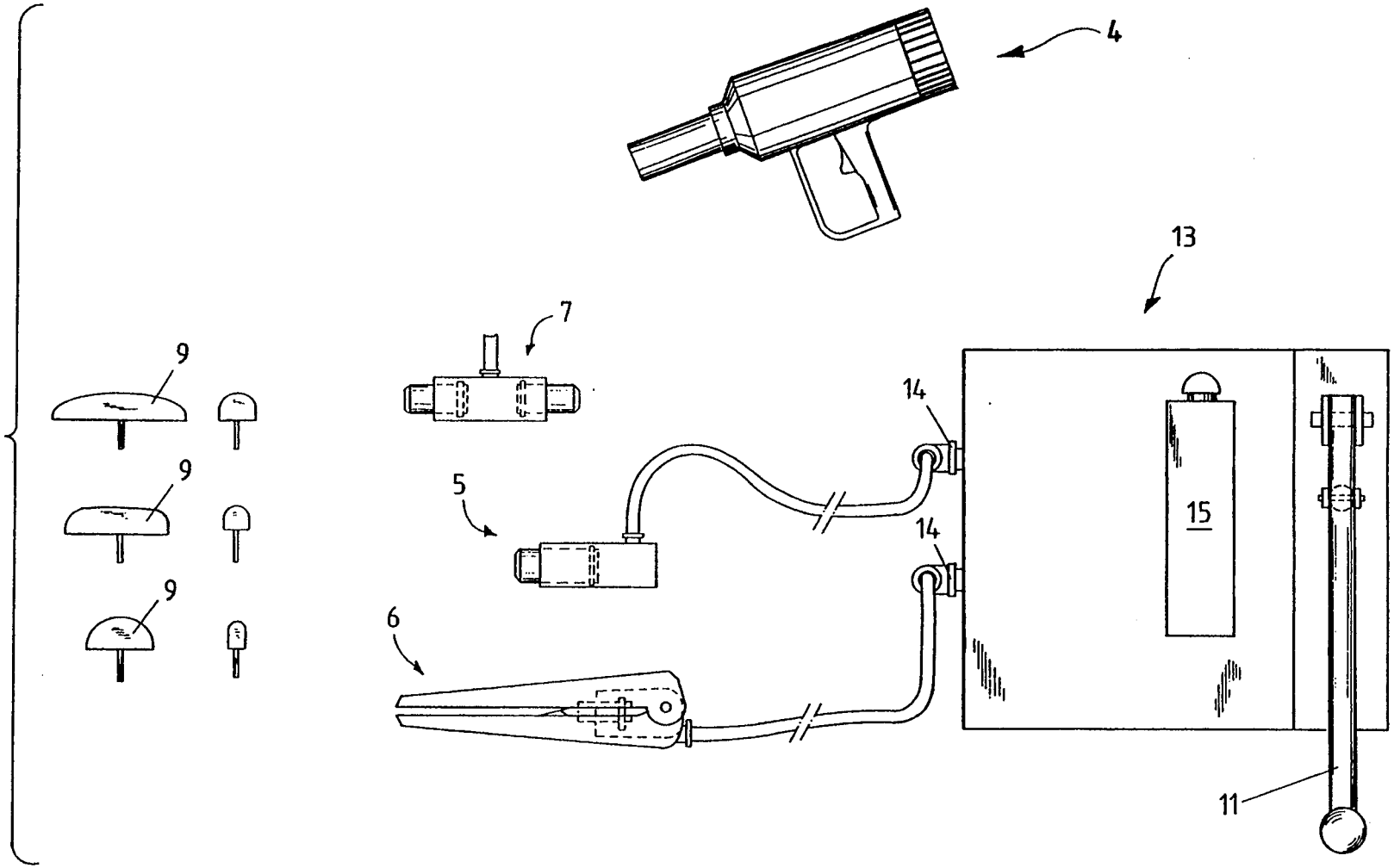
FIG. 3 shows the principal components of the series of shaping implements.

By means of the series of implements shown in FIG. 3 it is possible to make most of the protrusions required in the outer shells of slalom boots. A series of this kind includes a hot-air blower 4, a hydraulic pump unit 13, pressing devices 5, 6, 7, and pressing heads 9 adapted to them. The pressing heads 9 are made form birch or other hard wooden material. Birch wood has been shown to be especially well suited to this purpose, because it is sufficiently hard and on the other hand it does not adhere to the heated plastic.

Figure 4:
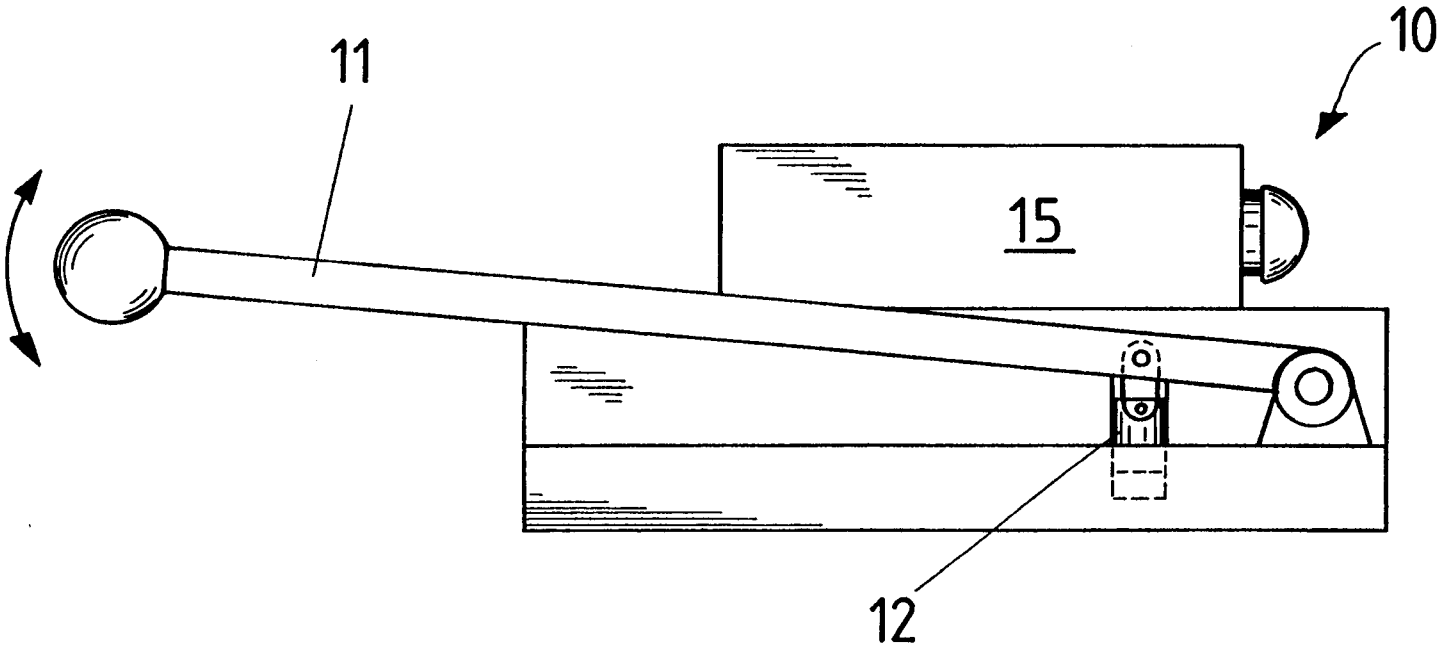
FIG. 4 shows the hydraulic jack unit seen from the side.

The pump unit 13 consists of a pump cylinder 12, FIG. 4, operated with the aid of lever 11, valve 15 to direct the pressurized oil to one of the two exit connections 14, to which the pressing devices 5, 6, 7 are connected. The pump unit 13 includes in addition an oil reservoir, and counter and shut-off valves.

Figure 5:
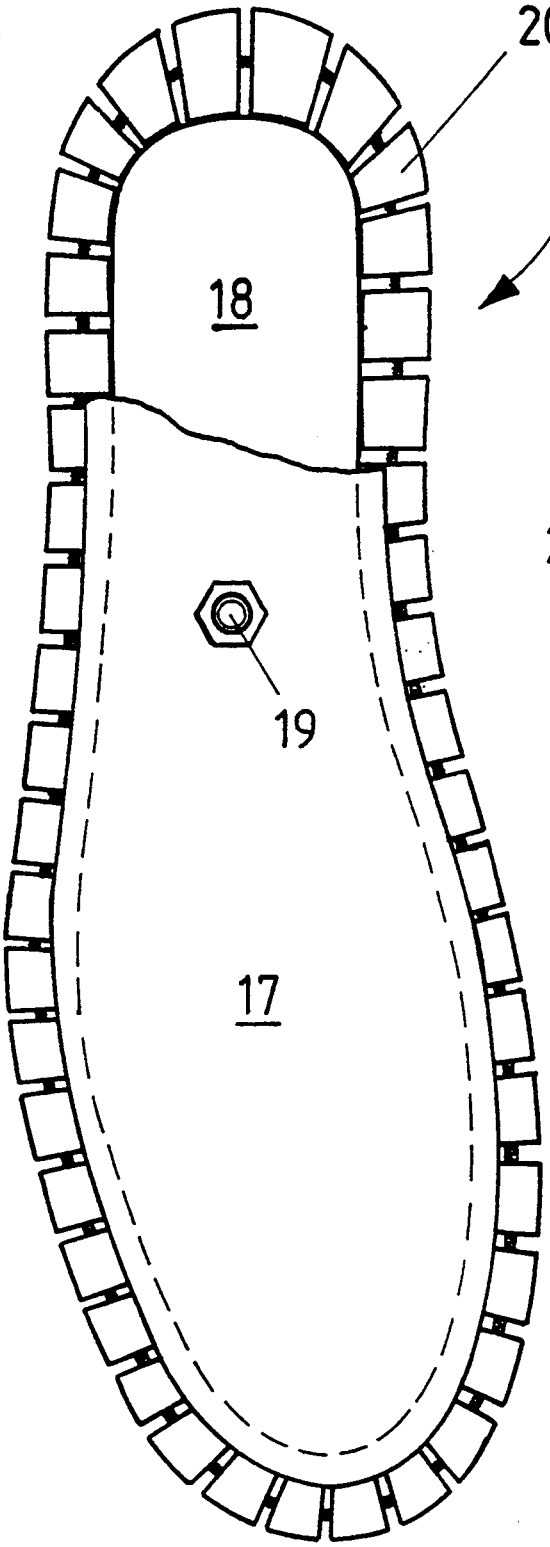
FIG. 5 shows a third pressing device.
Figure 6:
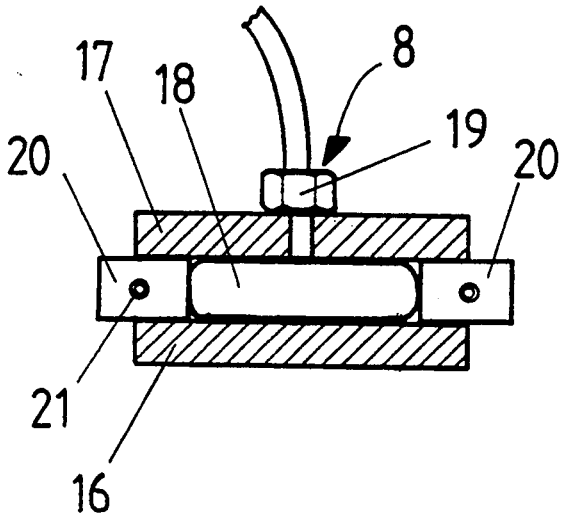
FIG. 6 shows a cross-section of the pressing device in FIG. 5.

If the pressing devices in accordance with FIGS. 5 and 6 are used, the place being shaped is determined in accordance with the heating point. Here the pressing device 8 includes two plates 16, 17 set a distance apart and a flexible bag is placed between them, which when compressed pushes the wooden pressing heads 20 set in the outer ring outwards against the inner wall of the boot. The pressing heads 20 are connected to each other by means of the spiral spring 21 threaded through them. Pressurized oil is fed to bag 18 through connection 19. The pressure is equally great in all directions, but a change in shape takes place only at the point of the external heating.

The shaping in accordance with the above is naturally carried out separately on each boot, from the measurement of the foot to the shaping of the boot.

While the best mode for carrying out the invention has been described in detail, those familiar with the art to which this invention relates will recognize various alternative ways of practicing the invention as defined by the following claims.

What is claimed is:

1. A method of shaping slalom boots, consisting of a hard plastic outer shell and an inner boot made of flexible material, to conform with individual protrusions of a user's foot and comprising the steps of:

forming a pattern depicting the sole of the user's foot from an inflexible material;

placing the pattern inside the boot;

locally heating a point corresponding to a protrusion in the pattern from outside the boot by hot-air blowing; and pressing the heated point from inside the boot using a wooden shaping head to stretch the plastic material to conform to the protrusion in the pattern.

2. The method of claim 1 wherein:

the heating step is performed by a hot-air blower;

the pressing step is performed by at least one pressing device; and wherein said wooden shaping head is attached to the pressing device.

3. The method of claim 2 wherein:

the pressing step is performed by a pair of shaping heads intended to broaden the heel and a pressing device fitted between the shaping heads.

4. The method of shaping of claim 2 wherein the pressing step is performed hydraulically.

5. The method of shaping of claim 2 wherein:

the pressing step is performed using three rounded wooden shaping heads of varying lengths to make local protrusions.

6. The method of shaping of claim 2 wherein:

the pressing step is performed by a pressing device including two spaced plates, a flexible bag with hydraulic fluid connections set between the plates and wooden pieces surrounding the bag and protruding between the plates, the extreme edge of which is essentially the shape of a part of the sole.

* * * * *